US008022883B2

(12) United States Patent
Shinkawa et al.

(10) Patent No.: US 8,022,883 B2
(45) Date of Patent: Sep. 20, 2011

(54) AM/FM WINDOWPANE ANTENNA PATTERN STRUCTURE WHEREIN FEEDING POINT IS DISPOSED THEREINSIDE

(75) Inventors: Tomohiro Shinkawa, Tokyo (JP); Takao Kato, Tokyo (JP); Nobuo Tamura, Novi, MI (US); Wassom Pierre, Novi, MI (US)

(73) Assignee: Mitsumi Electric Co., Ltd., Tama-Shi (JP)

( * ) Notice: Subject to any disclaimer, the term of this patent is extended or adjusted under 35 U.S.C. 154(b) by 352 days.

(21) Appl. No.: 12/336,958

(22) Filed: Dec. 17, 2008

(65) Prior Publication Data

US 2010/0149055 A1 Jun. 17, 2010

(51) Int. Cl.
*H01Q 1/32* (2006.01)

(52) U.S. Cl. ..... 343/713; 343/711

(58) Field of Classification Search ..... 343/713, 343/711

See application file for complete search history.

(56) References Cited

U.S. PATENT DOCUMENTS

| | | | | |
|---|---|---|---|---|
| 5,719,585 | A * | 2/1998 | Tabata et al. | 343/713 |
| 5,790,079 | A * | 8/1998 | Zafar | 343/713 |
| 5,986,612 | A * | 11/1999 | Nagy | 343/713 |
| 6,031,500 | A * | 2/2000 | Nagy et al. | 343/713 |
| 7,091,914 | B2 * | 8/2006 | Noguchi et al. | 343/713 |
| 7,642,976 | B2 * | 1/2010 | Taniguchi et al. | 343/713 |
| 2008/0169990 | A1 * | 7/2008 | Taniguchi et al. | 343/713 |

FOREIGN PATENT DOCUMENTS

| | | | |
|---|---|---|---|
| JP | 11-261321 | A | 9/1999 |
| JP | 2001-168623 | A | 6/2001 |
| JP | 2003-168908 | A | 6/2003 |
| JP | 2008-301218 | A | 12/2008 |

OTHER PUBLICATIONS

Korean Office Action dated Jan. 20, 2011 (and English translation of relevant part thereof) in counterpart Korean Application No. 10-2009-0041265.

* cited by examiner

*Primary Examiner* — Trinh V Dinh

(74) *Attorney, Agent, or Firm* — Holtz, Holtz, Goodman & Chick, PC

(57) ABSTRACT

In an automobile rear windowpane antenna apparatus including a defogger disposed on a rear windowpane plate at a lower portion thereof an antenna pattern is disposed above the defogger on the rear windowpane plate at an upper portion thereof and is disposed so as to extend between near a right end edge of a window frame and near a left end edge thereof. A feeding point is disposed inside the antenna pattern.

7 Claims, 2 Drawing Sheets

AM/FM WINDOWPANE ANTENNA PATTERN STRUCTURE WHEREIN FEEDING POINT IS DISPOSED THEREINSIDE

BACKGROUND OF THE INVENTION

This invention relates to an automobile rear windowpane antenna apparatus disposed on a rear windowpane plate of a vehicle and, in particular, to an AM/FM windowpane antenna pattern structure.

The rear windowpane plate is enclosed with a substantially rectangular window edge. That is, the window edge consists of an upper end edge, a lower end edge, a right end edge, and a left end edge. Inasmuch as the right end edge and the left end edge extend in a vertical direction, they are called a pair of rear pillars. In other words, the rear windowpane plate comprises the pair of rear pillars at both ends laterally.

The rear windowpane plate is enclosed with a substantially rectangular window edge. That is, the widow edge consists of an upper end edge, a lower end edge, a right end edge, and a left end edge. Inasmuch as the right end edge and the left end edge extend in a vertical direction, they are called a pair of rear pillars. In other words, the rear windowpane plate comprises the pair of rear pillars at both ends laterally.

The fog preventing apparatus (the defogger) is disposed on the rear windowpane plate at a lower portion thereof. The defogger comprises a plurality of heater lines extending in a horizontal direction and a pair of bus bars which is disposed close proximity to the above-mentioned pair of rear pillars to feed the plurality of heater lines with power. The pair of bus bars extends in the vertical direction. One of the pair of bus bars is connected to a DC power source while another thereof is grounded.

Various automobile rear windowpane antenna apparatuses of the type are already proposed previously. By way of illustration, Japanese Unexamined Patent Application Publication No. H11-261321 (JP-A-11-261321) discloses an automobile rear windowpane antenna apparatus comprising an antenna conductor (an antenna pattern) and a feeding point which are disposed above the defogger at an upper portion of the rear windowpane plate. The antenna conductor is for receiving an AM broadcasting band and an FM broadcasting band. The antenna conductor comprises a substantially horizontal element and a loop-shaped element. The loop-shaped element is disposed between the substantially horizontal element and the defogger. The substantially horizontal element and the loop-shaped element are connected to a feeding point.

In the automobile rear windowpane antenna apparatus disclosed in JP-A-11-261321, the feeding point is disposed between either of the pair of rear pillars and the antenna conductor (the antenna pattern).

Other Japanese Unexamined Patent Application Publications are similar in structure to JP-A-11-261321. For example, in an automobile rear windowpane antenna apparatus disclosed in Japanese Unexamined Patent Application Publication No. 2001-168623 (JP-A-2001-168623), a feeding point is disposed close proximity to a right-upper side portion of a rear windowpane plate when seeing from the inside of the vehicles or the outside of the vehicles. In addition, in an automobile rear windowpane antenna apparatus disclosed in Japanese Unexamined Patent Application Publication No. 2003-168908 (JP-A 2003-168908), a feeding point is also disposed between either of a pair of rear pillars and an antenna conductor (an antenna pattern).

However, if the feeding point is disposed between either of the pair of rear pillars and the antenna conductor (the antenna pattern), the antenna conductor (the antenna pattern) has a smaller effective area. As a result, the conventional automobile rear windowpane antenna apparatuses are disadvantageous in that it is difficult to make a gain thereof large.

SUMMARY OF THE INVENTION

It is therefore an exemplary object of the present invention to provide an automobile rear windowpane antenna apparatus which is capable of widening an effective area of an antenna pattern.

It is another exemplary object of the present invention to provide an automobile rear windowpane antenna apparatus which is capable of improving a gain thereof.

Other objects of this invention will become clear as the description proceeds.

On describing the gist of an exemplary aspect of this invention, it is possible to be understood that an automobile rear windowpane antenna apparatus is disposed on a rear windowpane plate of a vehicle. The rear windowpane plate has a window edge which consists of an upper end edge, a lower end edge, a right end edge, and a left end edge. According to the exemplary aspect of this invention, the automobile rear windowpane antenna apparatus comprises a defogger disposed on the rear windowpane plate at a lower portion thereof and an antenna pattern disposed above the defogger on the rear windowpane plate at an upper portion thereof. The antenna pattern is disposed so as to extend between near the right end edge and near the left end edge. A feeding point is disposed inside the antenna pattern.

DESCRIPTION OF THE PREFERRED EMBODIMENTS

Figure 1:
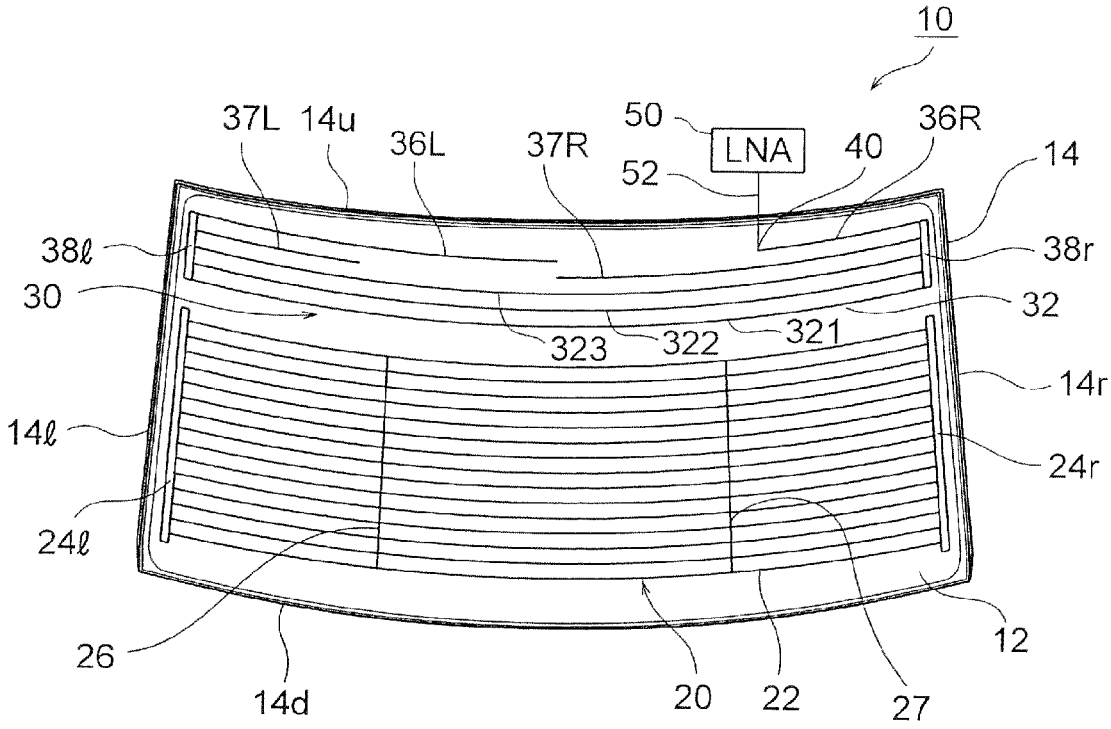
FIG. 1 is a front view showing an automobile rear windowpane antenna apparatus according to a first exemplary embodiment of this invention.
Figure 2:
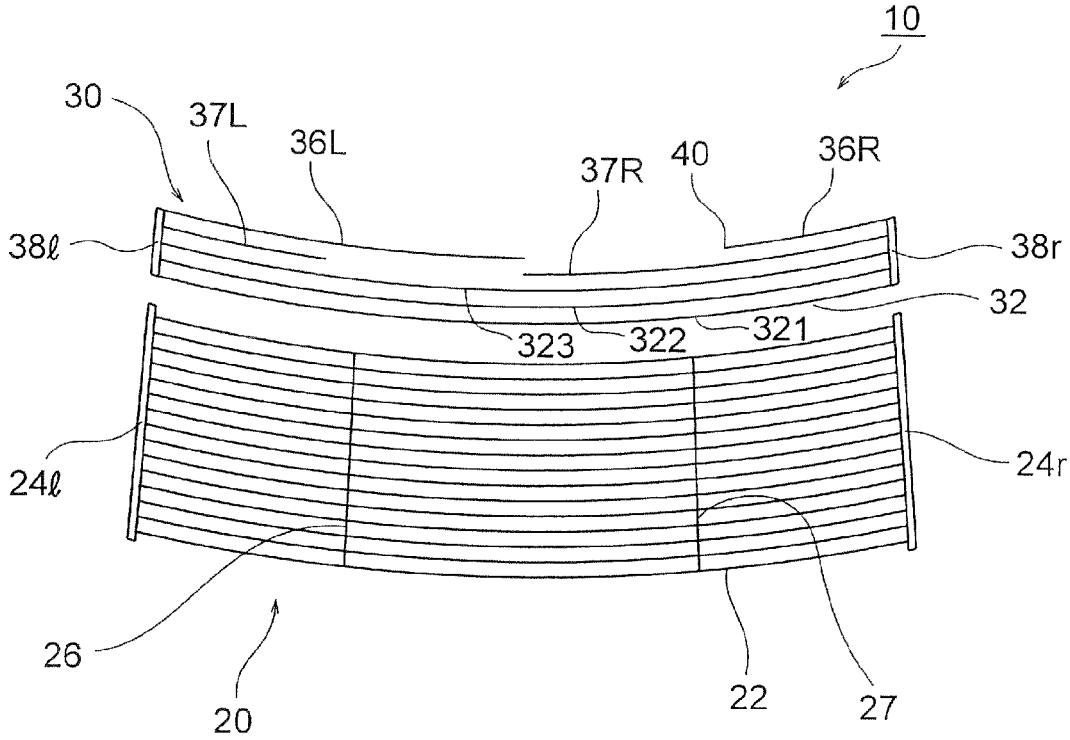
FIG. 2 is a front view of the automobile rear windowpane antenna apparatus where a rear windowpane plate and a low noise amplifier (LNA) are omitted from FIG. 1.

Referring to FIGS. 1 and 2, the description will proceed to an automobile rear windowpane antenna apparatus 10 according to a first exemplary embodiment of the present invention. FIG. 1 is a front view showing the automobile rear windowpane antenna apparatus 10. FIG. 2 is a front view of the automobile rear windowpane antenna apparatus 10 where a rear windowpane plate (which will later be described) and a low noise amplifier (LNA) (which will later be described) are omitted from FIG. 1.

The illustrated automobile rear windowpane antenna apparatus 10 is mounted on a rear windowpane plate 12 for use in a vehicle. The rear windowpane plate 12 is enclosed with a substantially rectangular window edge 14. The window edge 14 consists of an upper end edge 14*u*, a lower end edge 14*d*, a right end edge 14*r*, and a left end edge 14*l*. The right end edge 14*r* and the left end edge 14*l* are called a pair of rear pillars because they extend in a vertical direction. That is, the rear windowpane plate 12 comprises the pair of rear pillars at both sides laterally.

The rear windowpane plate 12 has a lower potion on which a fog preventing apparatus (a defogger) 20 is disposed. The fog preventing apparatus (the defogger) 20 is an apparatus in which heater lines are disposed on the rear windowpane plate 12, a DC current is applied to the heater lines to cause heating to remove fogging due to moisture adhered to the rear windowpane plate 12, and results in ensuring visibility.

More specifically, the defogger 20 comprises a plurality of heater lines 22 which extend in a horizontal direction, and a right-hand bus bar 24*r* and a left-hand bus bar 241 which are disposed close proximity to the above-mentioned right end edge 14*r* and the above-mentioned left end edge 14*l*, respectively. The right-hand bus bar 24*r* and the left-hand bus bar 24*l* are for feeding the plurality of heater lines 22 with power. The right-hand bus bar 24*r* and the left-hand bus bar 24*l* are called a pair of bus bars. The pair of bus bars 24*r* and 24*l* extends in the vertical direction. One of the pair of bus bars 24*r* and 24*l* is connected to a DC power source (not shown) while another thereof is grounded.

The illustrated defogger 20 further comprises two short-circuit lines 26 and 27 which extend in the vertical direction to short-circuit the plurality of heater lines 22.

The automobile rear windowpane antenna apparatus 10 comprises an antenna pattern (an antenna conductor) 30 which is disposed above the defogger 20 on the rear windowpane plate 12 at a lower portion thereof. The antenna pattern 30 is for receiving an AM broadcasting band and an FM broadcasting band. The antenna pattern 30 is disposed so as to extend between near the right end edge 14*r* and near the left end edge 14*l*.

In the first exemplary embodiment of the present invention, the automobile rear windowpane antenna apparatus 10 comprises a feeding point 40 which is disposed inside the antenna pattern 30.

More specifically the antenna pattern 30 comprises a grating element 32 disposed close proximity to the defogger 20 and first and second horizontal elements 36 and 37 disposed close proximity to the grating element 32 upwards.

The illustrated grating element 32 comprises only three horizontal components 321, 322, and 323 which extend in the horizontal direction.

The first and the second horizontal elements 36 and 37 extend in the horizontal direction and have lengths which are different from each other. The first and the second horizontal elements 36 and 37 are connected to the grating element 32 through a right-hand connecting conductor 38*r* and a left-hand connecting conductor 38*l* close proximity to the right end edge 14*r* and the left end edge 14*l*, respectively. Herein, inasmuch as the first horizontal element 36 is disposed close proximity to the upper end edge 14*u* of the window frame 14, the first horizontal element 36 is also called an uppermost horizontal element.

More specifically, the first horizontal element (the uppermost horizontal element) 36 comprises a first right-hand horizontal element 36R and a first left-hand horizontal element 36L. The first right-hand horizontal element 36R extends from the right-hand connecting conductor 38*r* toward the left-hand connecting conductor 381 in the horizontal direction. The first left-hand horizontal element 36L extends from the left-hand connecting conductor 38*l* toward the right-hand connecting conductor 38*r* in the horizontal direction. The first right-hand horizontal element 36R has a tip which is separated from a tip of the first left-hand horizontal element 36L. The first right-hand horizontal element 36R has a length which is shorter than that of the first left-hand horizontal element 36L. In the example being illustrated, the length of the first left-hand horizontal element 36L is substantially equal to half of a distance between the right-hand connecting conductor 38*r* and the left-hand connecting conductor 38*l*.

Likewise, the second horizontal element 37 comprises a second right-hand horizontal element 37R and a second left-hand horizontal element 37L. The second right-hand horizontal element 37R extends from the right-hand connecting conductor 38*r* toward the left-hand connecting conductor 38*l* in the horizontal direction. The second left-hand horizontal element 37L extends from the left-hand connecting conductor 38*l* toward the right-hand connecting conductor 38*r* in the horizontal direction. The second right-hand horizontal element 37R has a tip which is separated from a tip of the second left-hand horizontal element 37L. The second right-hand horizontal element 37R has a length which is longer than that of the second left-hand horizontal element 37L. In the example being illustrated, the length of the second right-hand horizontal element 37R is substantially equal to half of the distance between the right-hand connecting conductor 38*r* and the left-hand connecting conductor 38*l*.

As shown in FIG. 1, the feeding point 40 is mounted to an internal tip of the uppermost horizontal element (the first horizontal element) 36. In the example being illustrated, the feeding point 40 is mounted to the tip of the first right-hand horizontal element 36R. The feeding point 40 is disposed at a position so that a distance between the feeding point 40 and a low noise amplifier (LNA) 50 becomes the shortest distance.

In the manner which is described above, inasmuch as the feeding point 40 is disposed inside the antenna pattern 30, it is possible to widen an effective area of the antenna pattern 30. As a result, it is possible to improve a gain of the antenna pattern 30 (the automobile rear windowpane antenna apparatus 10).

A position able to dispose the feeding point 40 changes due to a shape of the vehicle. However, by changing the length of the first right-hand horizontal element 36R in the uppermost horizontal element (the first horizontal element) 36, it is possible to dispose the feeding point 40 in the shortest distance between the low noise amplifier (LNA) 50 and the feeding point 40. As a result, it is possible to provide a cable 52 for connecting the low noise amplifier (LNA) 50 with the antenna pattern 30 in the shortest possible distance. Accordingly, the antenna pattern 30 (the automobile rear windowpane antenna apparatus 10) has a better antenna characteristic.

Inasmuch as it is possible to adjust impedance of the antenna pattern 30 using the grating element 32, it is possible to easily carry out impedance adjustment.

In the manner which is described above, inasmuch as it is possible to dispose the feeding point 40 at an ideal position, it is possible to widen the effective area of the antenna pattern 30 and it is possible to improve the gain of the antenna pattern 30 (the automobile rear windowpane antenna apparatus 10).

Although the feeding point 40 is mounted to the tip of the first right-hand horizontal element 36R in the automobile rear windowpane antenna apparatus 10 illustrated in FIGS. 1 and 2, the feeding point 40 may be mounted to the tip of the first left-hand horizontal element 36L. Under the circumstances, it is possible to change the length of the first left-hand horizontal element 36L so as to match the position of the feeding point 40.

Depending on the position of the feeding point 40, the length of the first right-hand horizontal element 36R or the first left-hand horizontal element 36L is determined. In addition, adjustment of the impedance of the antenna pattern 30 (the automobile rear windowpane antenna apparatus 10) is carried out by changing the length of the second right-hand horizontal element 37R, the length of the second left-hand horizontal element 37L, and the length of one of the first right-hand horizontal element 36R and the first left-hand horizontal element 36L that the feeding point 40 is not mounted to.

Figure 3:
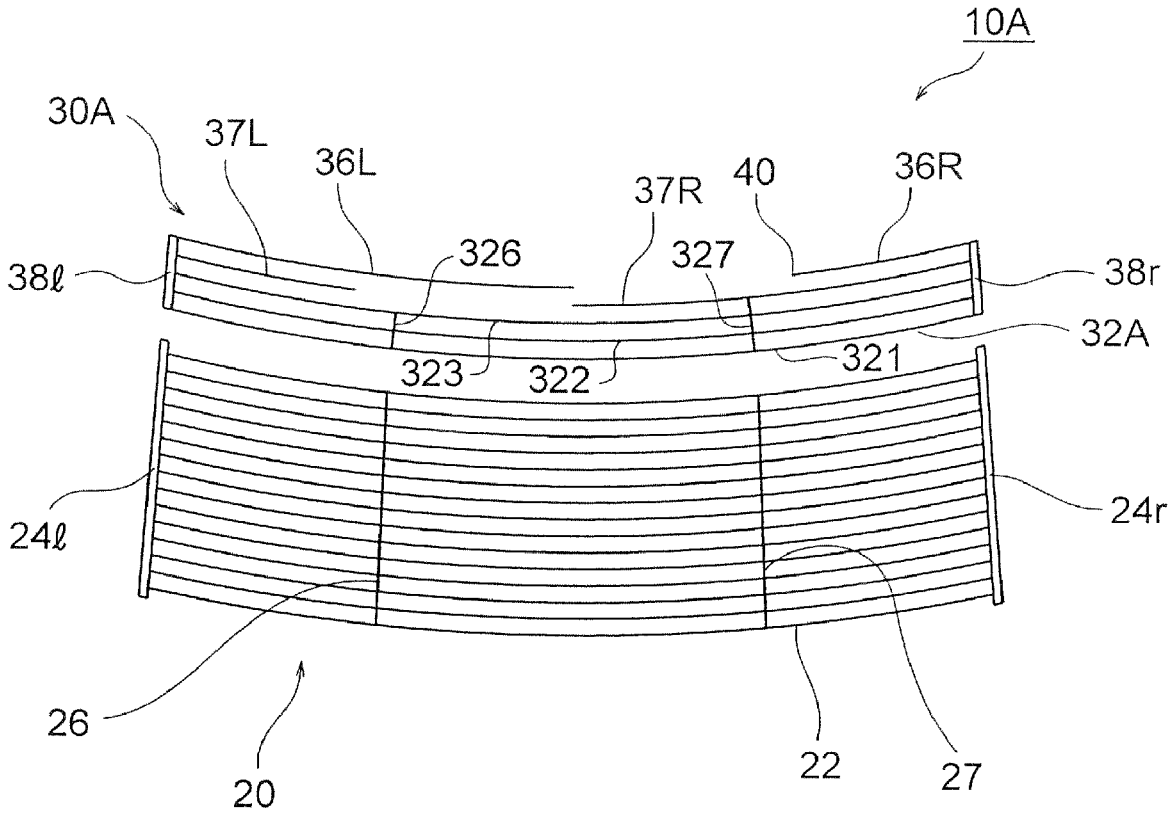
FIG. 3 is a front view showing an automobile rear windowpane antenna apparatus according to a second exemplary embodiment of this invention with a rear windowpane plate and a low noise amplifier (LNA) omitted therefrom.

Referring to FIG. 3, the description will proceed to an automobile rear windowpane antenna apparatus 10A according to a second exemplary embodiment of the present invention. FIG. 3 is a front view showing the automobile rear windowpane antenna apparatus 10A. However, in FIG. 3, illustration of the rear windowpane plate 12 and the low noise amplifier (LNA) 50 are omitted as in the case of FIG. 2.

The illustrated automobile rear windowpane antenna apparatus 10A is similar in structure to the automobile rear windowpane antenna apparatus 10 illustrated in FIG. 1 except that the antenna pattern is modified from that illustrated in FIG. 1 as will later become clear. The antenna pattern is therefore depicted at a reference symbol of 30A. The same reference symbols are attached to those having similar functions illustrated in FIG. 1, only different points will later be described for the sake of simplification of the description.

The illustrated antenna pattern 30A is similar in structure to the antenna pattern 30 illustrated in FIG. 2 except that the grating element is modified from that illustrated in FIG. 2 as will later become clear. The grating element is therefore depicted at a reference symbol of 32A.

The grating element 32 illustrated in FIG. 2 comprises only the three horizontal components 321, 322, and 323 which extend in the horizontal direction. In contract to this, the grating element 32A illustrated in FIG. 3 comprises not only the three horizontal components 321 to 323 but also two vertical components 326 and 327 which extend in the vertical direction.

Although the grating element 32A comprises the two vertical components 326 and 327 in the second exemplary embodiment illustrated in FIG. 3, the number of the vertical components may be one or three or more.

In the automobile rear windowpane antenna apparatus 10 according to the first exemplary embodiment of this invention illustrated in FIG. 1, the adjustment of the impedance of the antenna pattern 30 is carried out by changing the length of the second right-hand horizontal element 37R, the length of the second left-hand horizontal element 37L, and the length of one of the first right-hand horizontal element 36R and the first left-hand horizontal element 36L that the feeding point 40 is not mounted to.

In contract to this, in the automobile rear windowpane antenna apparatus 10A according to the second exemplary embodiment of this invention illustrated in FIG. 3, adjustment of the impedance of the antenna pattern 30A may be carried out by changing any ones of positions, lengths, and the presence or absence of the two vertical components 326 and 327 extending in the vertical direction or combinations thereof as well as the above-mentioned lengths.

In the exemplary aspect of this invention, it is preferable that the antenna pattern may comprise a grating element disposed close proximity to the defogger, and a plurality of horizontal elements which are disposed close proximity to the grating element upwards and which extend in the horizontal direction. The plurality of horizontal elements may be connected to the grating element close proximity to the right end edge and close proximity to the left end edge. In this event, the feeding point desirably may be mounted to an internal tip of the uppermost one among the plurality of horizontal elements. The plurality of horizontal elements may have lengths which are different from one another. The upper most horizontal element may comprise a right-hand horizontal element and a left-hand horizontal element. In this event, the feeding point is mounted to one of a tip of the right-hand horizontal element and a tip of the left-hand horizontal element. The grating element may comprise only a plurality of horizontal components which extend in the horizontal direction. Alternatively, the grating element may comprise a plurality of horizontal components extending in the horizontal direction and at least one vertical component extending in the vertical direction. The feeding point preferably may be disposed at a position so that the feeding point and a low noise amplifier becomes the shortest distance.

An exemplary advantage according to the invention is that it is possible to widen an effective area of the antenna pattern and to improve a gain thereof. This is because the feeding point is disposed inside the antenna pattern.

While this invention has been particularly shown and described with reference to exemplary embodiments thereof, the invention is not limited to these embodiments. It will be understood by those of ordinary skill in the art that various changes in form and details may be therein without departing from the spirit and scope of the present invention as defined by the claims. For example, although the description is made by taking, as an example, the two horizontal elements in the antenna pattern in the above-mentioned exemplary embodiments, the number of the horizontal elements is not restricted to two and may be three or more.

What is claimed is:

1. An automobile rear windowpane antenna apparatus mounted on a rear windowpane plate, said rear windowpane plate having a window edge which consists of an upper end edge, a lower end edge, a right end edge, and a left end edge, said automobile rear windowpane antenna apparatus comprising:

a defogger disposed on said rear windowpane plate at a lower portion thereof;

an antenna pattern disposed above said defogger on said rear windowpane plate at an upper portion thereof, wherein said antenna pattern is disposed so as to extend between a right-hand connecting conductor disposed substantially at said right end edge and a left-hand connecting conductor disposed substantially at said left end edge; and a feeding point disposed inside said antenna pattern;

wherein said antenna pattern comprises:

a grating element disposed in close proximity to said defogger; and a plurality of horizontal elements which are disposed in close proximity to and upwards of said grating element and which extend in a horizontal direction, said plurality of horizontal elements being connected to said grating element through said right-hand connecting conductor and said left-hand connecting conductor;

wherein said feeding point is mounted to an internal tip of a first horizontal element, said first horizontal element being an uppermost one among said plurality of horizontal elements;

wherein said first horizontal element comprises a first right-hand horizontal element and a first left-hand horizontal element, said feeding point being mounted to one of a tip of said first right-hand horizontal element and a tip of said first left-hand horizontal element.

2. The automobile rear windowpane antenna apparatus as claimed in claim 1, wherein said plurality of horizontal elements have lengths which are different from one another.

3. The automobile rear windowpane antenna apparatus as claimed in claim 1, wherein said grating element comprises a plurality of horizontal components which extend in the horizontal direction.

4. The automobile rear windowpane antenna apparatus as claimed in claim 3, wherein said grating element further comprises at least one vertical component which extends in a vertical direction.

5. The automobile rear windowpane antenna apparatus as claimed in claim 1, wherein said feeding point is disposed at a position so that a distance between said feeding point and a low noise amplifier becomes a shortest distance.

6. The automobile rear windowpane antenna apparatus as claimed in claim 1, wherein said plurality of horizontal elements includes a second horizontal element which is disposed between said first horizontal element and said grating element.

7. The automobile rear windowpane antenna apparatus as claimed in claim 6, wherein said second horizontal element comprises a second right-hand horizontal element and a second left-hand horizontal element, and wherein each of said first and said second right-hand horizontal elements has a tip which is opposed and separated from a tip of each of said first and said second left-hand horizontal elements.

* * * * *